US006338263B1

(12) United States Patent
Obata et al.

(10) Patent No.: US 6,338,263 B1
(45) Date of Patent: Jan. 15, 2002

(54) METHOD FOR MANUFACTURING EMBOSSED CAN BODY, INSPECTING APPARATUS USED FOR MANUFACTURING EMBOSSED CAN BODY, AND INSPECTING METHOD USED THEREFOR

(75) Inventors: Kazumoto Obata; Wataru Ookubo, both of Yokohama; Sunao Morishita, Kawasaki, all of (JP)

(73) Assignee: Toyo Seikan Kaisha, Ltd., Tokyo (JP)

( * ) Notice: Subject to any disclaimer, the term of this patent is extended or adjusted under 35 U.S.C. 154(b) by 0 days.

(21) Appl. No.: 09/599,266

(22) Filed: Jun. 22, 2000

(30) Foreign Application Priority Data

Jun. 30, 1999 (JP) ..... 11-186049
Jul. 19, 1999 (JP) ..... 11-204320
Dec. 28, 1999 (JP) ..... 11-373467

(51) Int. Cl.[7] ..... B21D 15/04

(52) U.S. Cl. ..... 72/105; 72/15.2; 72/15.3; 72/17.3; 72/94; 72/379.4

(58) Field of Search ..... 72/11.1, 15.2, 72/15.3, 17.3, 105, 106, 379.4, 420, 421, 84, 85, 94, 110; 220/671, 674

(56) References Cited

U.S. PATENT DOCUMENTS 3,628,451 A * 12/1971 McClellan ..... 101/4
4,870,847 A * 10/1989 Kitt ..... 72/84
5,078,564 A * 1/1992 Zago ..... 72/94
5,448,903 A * 9/1995 Johnson ..... 72/94
5,916,317 A * 6/1999 Willoughby et al. ..... 72/61
5,941,109 A * 8/1999 Johnson et al. ..... 72/17.3
5,970,767 A * 10/1999 Hartman et al. ..... 72/58
6,009,733 A * 1/2000 Cheers et al. ..... 72/94

* cited by examiner

*Primary Examiner*—Ed Tolan
(74) *Attorney, Agent, or Firm*—Kanesaka & Takeuchi

(57) ABSTRACT

A method for manufacturing an embossed can body with a pattern printed on an outer surface of a cylindrical can barrel includes a plastic working step for forming a flange portion and a neck portion at an opening peripheral edge of the can barrel, and an embossing step for forming an embossed portion on at least a part of the pattern while aligning with the pattern. Thus, the pattern and the embossed portion can be aligned easily and accurately. Also, a stopping mark and a confirmation mark are formed on the can barrel, and a first sensor corresponding to the stopping mark and a second sensor corresponding to the confirmation mark are used. When the respective first and second sensors detect the stopping mark and the confirmation mark, it can be confirmed that the pattern on the can barrel is oriented in a predetermined direction.

7 Claims, 13 Drawing Sheets

METHOD FOR MANUFACTURING EMBOSSED CAN BODY, INSPECTING APPARATUS USED FOR MANUFACTURING EMBOSSED CAN BODY, AND INSPECTING METHOD USED THEREFOR

FIELD OF THE INVENTION

The present invention relates to a method for manufacturing an embossed can body where a pattern is printed on an outer surface of a cylindrical can barrel, and one or both of a projection portion and a recess portion are registered with the pattern and are formed on at least one portion of the pattern, in particular, a method for manufacturing an embossed can body which can perform an alignment between a pattern and at least one portion of a projection portion and a recess portion (a projection portion/a recess portion) securely.

BACKGROUND ART

In recent years, because of variety in design, improvement in strength of a can barrel according to thinning a wall thickness of a can barrel, and the like, an embossed can body whose can barrel has been subjected to one or both of projecting working and recessing working is developed and commercialized.

In this case, when one or both of projecting work and recessing work are performed on the embossed can body with alignment with a pattern, a character or the like (which are collectively referred to as pattern) which has been printed on the embossed can body, a design performance of the embossed can body can be improved. For this reason, an embossing of one or both of a recess portion and a projection portion corresponding to a pattern is performed on at least one portion of the pattern.

FIG. 12 is a perspective view of one example of an embossed can body.

An embossed can body 10 shown in FIG. 12 is a three piece can comprising a can barrel 11', a can lid 12 and a can bottom 13. The can barrel 11' is made of a metal thin plate, and is formed in a cylindrical shape by welding both ends of the thin plate at welding portions 14.

Printed at an upper portion on an outer surface of the can barrel 11' is a pattern (characters) 11*d* which is "BEER". Also, a pattern (characters) 15 which is "CAN" and which is worked to be recessed or projected is largely printed at a central portion of the outer surface of the can barrel.

The patterns 11*d*, 15 are covered with a polyester film or an organic coating after they are printed on the outer surface of the can barrel 11'. The patterns may be printed on a back surface (a surface contacting with an outer surface of the can barrel) of the polyester film or the organic coating in advance.

Recess portions 16 which correspond to "CAN" are formed on the can body 11' in a state where they are aligned with the pattern 15. In an aspect where the forming is performed in the state where the pattern 15 and the recess portions 16 correspond to each other, it is not limited to an aspect where the entire pattern corresponds to the entire recess portions. An aspect where the pattern 15 corresponds to a portion of the recess 16 may be allowed. For example, an aspect where recessing is performed on only "A" of the pattern "CAN" or printing is performed on "A" of the recess portion "CAN" may be possible.

As conventional techniques for performing such one or both of a recess portion and a projection portion forming work on a can barrel, there have been known the title "TOOLING AND METHOD THE EMBOSSING OF A CONTAINER AND THE RESULTING CONTAINER" of International Laid-Open Publication No. WO98/03279 and the title "METHOD OF ORIENTING CANS" of No. WO97/21505.

In these conventional techniques, a positioning mark 17 indicating a position of a pattern portion is formed on the can barrel 11' in order to position forming means for performing one or both of a recess portion and a projection portion forming work to the pattern portion of the can barrel, as shown with a can body 10 in FIG. 12 and the mark 17 is read by a sensor, so that the rotation of the can barrel 11' is controlled such that the pattern 15 is positioned so as to correspond to the forming means.

Also, for the purpose of reducing manufacturing cost of a can body, a rotary type apparatus and a method for performing recess and projection working at a high speed have been disclosed, for example, in International Laid-Open Publication Nos. WO98/03279 and WO98/03280.

FIG. 13 is a diagram explaining procedures for performing recess and projection working on the can barrel 11' by the above rotary type apparatus and method.

The can barrel 11' is introduced from a position shown with (1) in FIG. 13. The positioning mark 17 (refer to FIG. 12) of the introduced can barrel 11' is detected at turret positions (1) and (2) by sensors 151 or the like arranged at respective pockets.

The sensors 151 or the like detect the mark 17. The can barrel 11' is rotated such that the pattern 15 faces a predetermined position (a position which corresponds to recess/projection portion of a forming die). Thereafter, while the attitude of the can barrel 11' is maintained, the can barrel 11' is sent up to a position shown with a turret position (3) in FIG. 13 where an inner roller 101 is inserted.

Also, a cam member 140 is disposed outside the inner roller 101 over a range slightly larger than a range of a turret positions (3) to (9). The cam member 140 shifts the outer roller 102 towards the inner rollers 101 by means of a cam roller (not shown). Thereby, an inner wall of the can barrel 11' positioned so as to contact the outer roller 102 is pressed on to the inner roller 101 in the range of the turret positions (4) to (8).

Then, a recess/projection working is performed on the can barrel 11' while the inner roller 101 and the outer roller 102 are being rotated in the range of the turret positions (4) to (8). When the can barrel 11' is fed up to the turret position (9), the pressing of the cam roller (not shown) effected by the cam member 140 is released, and the inner roller 101 comes out from the can barrel 11'.

In this manner, the working for the recess portion 16 is performed on the pattern 15 of the can barrel 11'. The can barrel 11' which has been worked is conveyed out at an discharging position A from the forming apparatus of the can body.

These conventional techniques are excellent inventions, but there are drawbacks to be improved in view of implementation thereof.

That is, in a case that embossing is performed at a high speed of 1,000 cans to 2,000 cans/min., when there is variation in shape of can barrels 11' such as circularity or the like, there occurs a case where the sensors 151 can not read the positioning mark 17 of the can barrel 11' accurately because the can barrel 11' is rotated at high speed. As a result, it becomes impossible to perform an accurate positioning so that the pattern 15 and the recess portion 16 do not correspond to each other in some cases.

Also, in can manufacturing steps, there occurs a case where the can barrel 11' becomes dirty or dusts stick to the can barrel 11'. In such a case, there is a case that the sensors 151 mistake dirt for the positioning mark 17. Particularly, in a can body which has the can barrel 11' having a metallic welded line such as a three piece can, there is a case where the sensors 151 mistake a welded portion for the positioning mark 17.

Furthermore, in a case that there are variations in shape of the can barrel 11', when the can barrel 11' sets to the inner rollers 101 which is a forming die for performing embossing, the set position of the can barrel 11' varies. As a result, there is a problem that embossing corresponding to the pattern 15 can not be performed securely.

Also, even if the orientation of the can barrel 11' is adjusted according to the positioning mark 17 before forming, when slippage occurs between the outer roller 102 and the can barrel 11', the pattern 15 and the recess portion 16 deviate from each other, thereby resulting in a poor product.

On the other hand, in order to inspect the pattern 15 and the recess portion 16 after formation, it is sufficient to detect by the sensors 151 provided in respective pots whether or not the positioning mark 17 is directed to a predetermined direction. However, when the outer rollers 102 are separated from the can barrel 11', there is a case that slippage between the can barrel 11' and the outer roller 102 occurs and the can barrel 11' rotates. In such a case, there is a drawback that, even when a product is a good one, it may be judged as a bad product erroneously.

These problems occur in an embossed can body of a two piece can like the above.

DISCLOSURE OF THE INVENTION

An object of the present invention is to obtain embossed can bodies having a high quality where a pattern and an embossing coincide with each other with a very high accuracy in a stable manner by solving the these problems.

A method for manufacturing an embossed can body of the present invention is a method for manufacturing an embossed can body where a pattern is printed on an outer surface of a cylindrical can barrel, alignment with the pattern is performed, and embossing of one or both of a recess portion and a projection portion is performed on at least one portion of the pattern, wherein a plastic working step for performing plastic working on one portion of a periphery of the can barrel to form a plastically deformed portion is provided prior to an embossing step for performing the alignment with the pattern to perform embossing of one or both of the recess portion and the projection portion on the pattern.

In the plastic working step, it is preferable that a neck portion and a flange portion are formed at an opening edge portion of the can barrel by the plastic working. Also, it is preferable to perform the alignment of the pattern and one or both of the recess portion and the projection portion by detecting a plurality of positioning marks provided on the pattern or a portion except for the pattern.

An inspecting apparatus of the present invention is an inspecting apparatus for a can body which is provided in a forming apparatus for a can body, the forming apparatus including one die on which a can barrel is mounted and the other die aligned with a pattern which has been printed on an outer surface of the can barrel to perform recess/projection working on at least one portion of the pattern of the can barrel, and which inspects whether or not the pattern and the worked recess and/or projection are aligned with each other, comprising: a camera positioned at a predetermined position and photographing the can body during a recess/projection working; inspecting timing detecting means for detecting a predetermined timing for inspection during the recess/projection working; image processing means for processing an image which has been photographed by the camera; and judging means for comparing an extraction pattern which has been taken out from the pattern and a reference pattern which has been set in advance with each other on the basis of the process result of the image processing means to set a first reference position at a predetermined position on the basis of the pattern when the extraction pattern and the reference pattern are identical and to obtain a distance between the first reference position and a second reference position which has been set at a predetermined position and for judging whether or not the distance between the first reference position and the second reference position is in an allowable range of a distance which has been set in advance.

It is preferable to set the first reference position to the position of the extraction pattern.

An inspecting method of the present invention is an inspecting method for a can body where the can body is mounted to one die, the other die is aligned with a pattern which has been printed on an outer surface of a barrel of the can body, and when a recess/projection working is performed on at least one portion of the pattern by the one die and the other die, inspection is made about whether or not the pattern and the worked recess/projection have been aligned with each other, comprising: the step of photographing at least one portion of the can body during a recess/projection working by a camera which has been positioned at a predetermined position; the step of extracting at least one portion of the pattern from an image which has been photographed by the camera at a predetermined timing during the recess/projection working; the step of setting a first reference position on the basis of the position of the extracted pattern when it is judged that one portion of the extracted pattern is identical to a reference pattern which has been set in advance; the step of photographing a mark which has been provided in advance together with the can body by the camera and setting the second reference position on the basis of the position of the mark when it is judged that the mark exists at a predetermined position in an image which has been photographed by the camera; and the step of obtaining the distance between the first reference position and the second reference position to judge whether or not the distance is in an allowable range of distance which has been determined in advance.

BEST MODE FOR CARRYING OUT THE INVENTION

Preferred embodiments of the present invention will be explained in detail below with reference to the drawings.

[Method for manufacturing an embossed can body]

A preferred embodiment of a method for manufacturing an embossed can body of the present invention will be explained with reference to FIGS. 1 to 4, FIG. 10 and FIG. 11.

Generally, in a two piece can, since a can barrel is formed by a drawing forming or a drawing-ironing forming, internal stress occurs in the can barrel due to anisotropy of material. Also, in a three piece can, internal stress occurs by welding effected after roll-forming of a thin plate. Furthermore, internal stress occurs in a can barrel due to variation of accuracy of a forming tool for performing drawing forming or roll forming. It is considered that variation in shape occurs for each can barrel due to strain caused by these internal stresses. Also, for example, when a can body is jammed on a conveying path during conveyance of the can body, external force acts on a can barrel so that slight deformation occurs in the can barrel in some cases.

In the manufacturing method of the present invention, a step where the shape of a can barrel constituting a can body is adjusted and plastic deformation is performed on the can barrel so that rigidity of the can barrel is increased and the adjusted shape is maintained is provided prior to an embossing step.

When plastic deformation is performed on one portion of the can barrel, the one portion is subjected to work hardening and the sectional configuration of the material for the can barrel is changed so that the rigidity of the one portion is increased. Thereby, the can barrel can be maintained in a constant shape, for example, in a circular shape. Then, detection of a positioning mark provided on the can barrel is performed securely, and the can barrel is set to an inner roll which is a forming die accurately, so that embossing coincident with a pattern is made possible.

Figure 2:
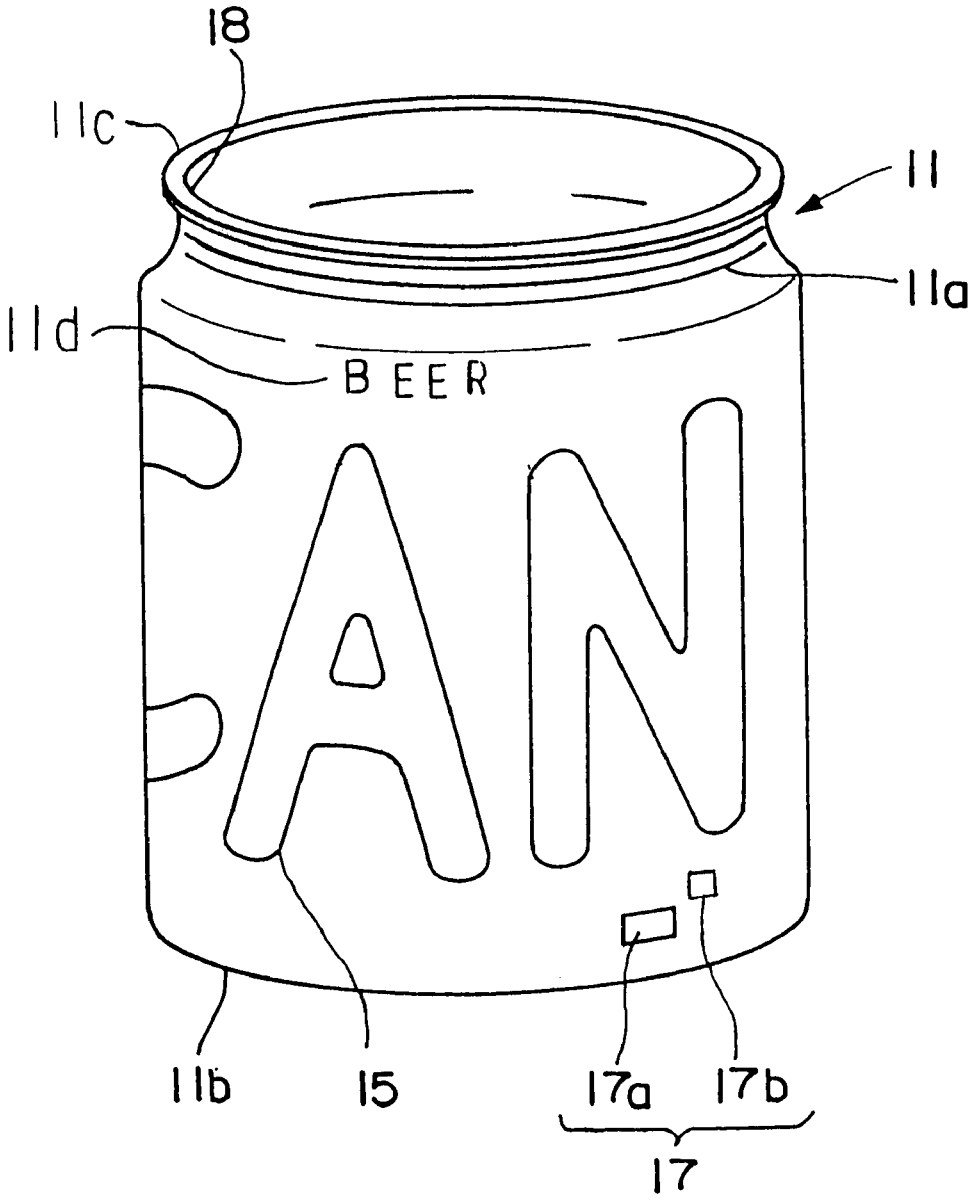
FIG. 2 is a perspective view of a can barrel before embossing, for explaining one example of a plastically deformed portion of the can barrel in the manufacturing method of the present invention.
Figure 3:
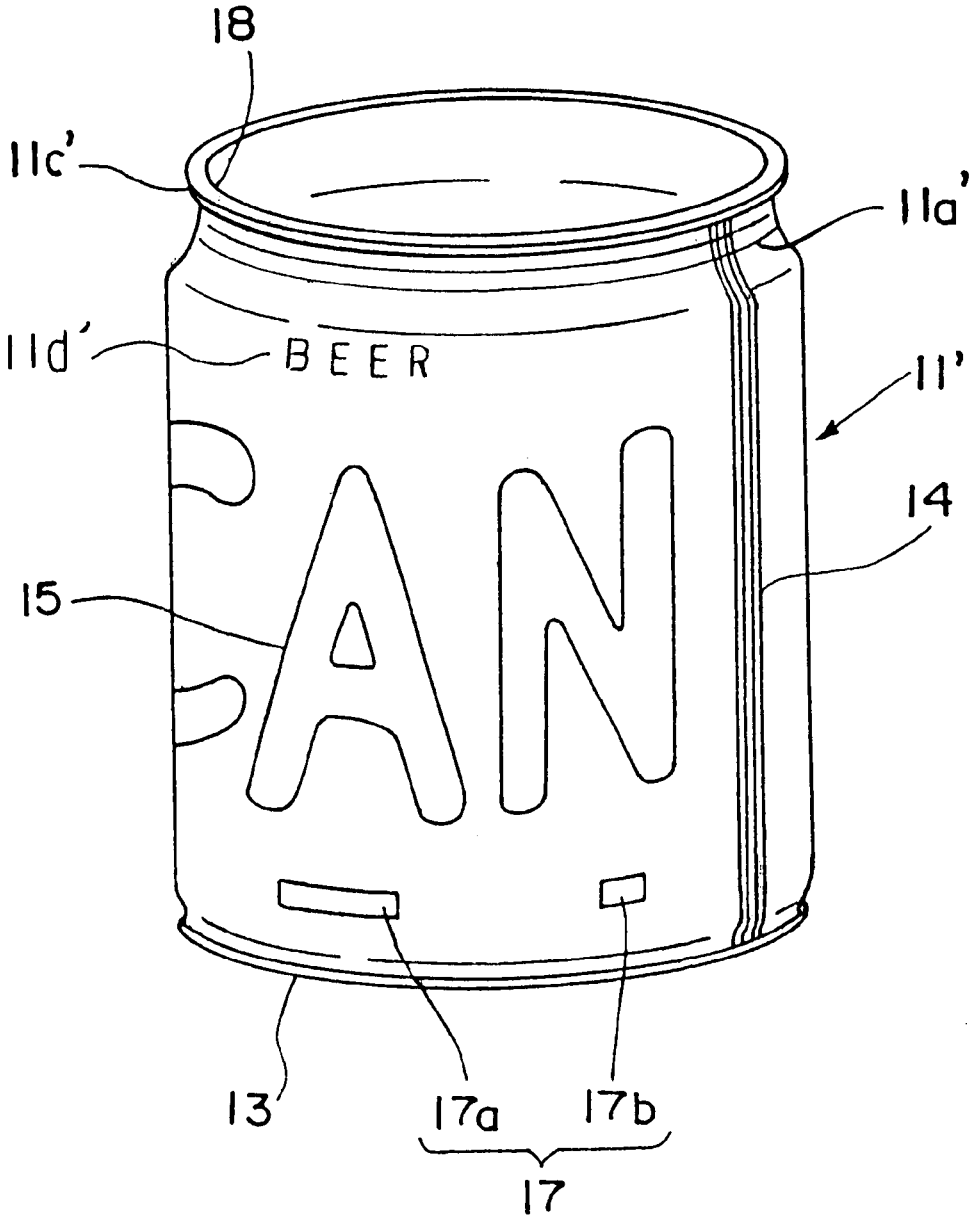
FIG. 3 is a perspective view of a can barrel before embossing, for explaining another example of a plastically deformed portion of the can barrel in the manufacturing method of the present invention.

FIG. 2 and FIG. 3 are views for explaining one example of a plastically deformed portion in the manufacturing method of the present invention. FIG. 2 is a perspective view of a can barrel 11 of a two piece can formed with a neck portion 11*a* and a flange portion 11*c* which are plastically deformed portions, and FIG. 3 is a perspective view of a can barrel 11' of a three piece can formed with a neck portion 11*a*' and a flange portion 11*c*' which are plastically deformed portions.

The can barrels shown in FIGS. 2 and 3 are ones prior to embossing.

A necking work is performed over the entire periphery of the peripheral edge of an opening portion 18 of the can barrel 11 shown in FIG. 2, and the neck portion 11*a* is formed by reducing the diameter of the can barrel 11. Furthermore, the flange portion 11*c* is formed by bending the peripheral edge of the neck portion 11*a* outwardly.

When the peripheral edge of the opening portion is adjusted to a circular shape while the necking work and the flange work are performed, the material forming the can barrel 11 is subjected to work hardening by the necking work and flanging work, so that the shape of the opening peripheral edge of the can barrel 11 can be maintained in a circular shape. Since the can barrel 11 is formed so as to have a bottom by drawing work, the can barrel 11 is maintained approximately over the whole thereof in a circular shape by the neck portion 11*a* and the can bottom lib positioned on both ends of the can barrel 11.

FIG. 3 is a perspective view of the can barrel 11' of a three piece can where, after a thin metal plate is rounded in a roll shape and a cylindrical body is formed by welding portions 14, a bottom lid 13 is fastened to one opening of the cylindrical body.

In a case of the three pieces can, the neck portion 11*a*' and the flange portion 11*c*' may be formed at opening peripheral edges on both ends of the cylindrical body. However, in the case of the three pieces can, the residual stress in the material is large as compared with the two pieces can, and there is a case that the rigidity at the both ends of the cylindrical body is insufficient even when it is increased. Therefore, it is preferable to seam the bottom lid 13 to one of the opening portions of the cylindrical body. In this case, seaming of the bottom lid 13 is ordinarily performed by double seaming. Also, the neck portion 11*a*' may be formed on only one end portion.

Of course, assuming that the shape of the can barrels 11, 11' can be kept constant, it is not required necessarily that the plastically deformed portion is formed at the opening peripheral edge, as shown in FIGS. 2 and 3. The plastically deformed portion can be formed at a central portion of the can barrel or any position thereof. Also, the shape of the plastically deformed portion may include one where the rigidity of the can barrels 11, 11' can be increased by work hardening or change in sectional configuration of material.

When the above can barrels 11, 11' are embossed, it is necessary to align the forming means for performing working of a recess portion 16 to a pattern 15 accurately. Positioning marks 17 are required for performing the alignment. In the manufacturing method of the present invention, two marks of a mark for stop (stopping mark for positioning) 17*a* and a mark for confirmation (confirming mark for positioning) 17*b* are used as the positioning marks 17.

The mark for stop 17*a* and the mark for confirmation 17*b* may be arranged on the same circular periphery of the can barrel 11, and they may be formed at positions different in a height direction, as shown in FIG. 2. Also, it is preferable that the mark for confirmation 17*b* is formed to be shorter than the mark for stop 17*a*. When the mark for confirmation 17*b* is made shorter than the mark for stop 17*a*, detection accuracy for position deviation can be improved.

In the three pieces can shown in FIG. 3, the length of the mark for stop 17*a* is longer than the width of the welding portion 14.

In the case of the three pieces can, since there is a case that the welding portion is mistaken for the positioning mark, the length of the mark for stop 17*a* is preferably made longer than the length of the welding portion 14 and the length of the mark for confirmation 17*b*. Then, with a structure where only when a mark having a predetermined length or more is detected by a sensor described later, the mark is recognized as the stop mark 17*a*, it is possible to prevent the welding portion 14 and the mark for confirmation 17*b* from being mistaken for the mark for stop 17*a*.

Incidentally, the positioning mark 17 is not limited to the above aspect. For example, a portion of the pattern 15 may be utilized as the positioning mark 17. Particularly, underline portions drawn below characters or the like as a portion of the pattern 15 may be utilized as the mark for stop 17*a* and the mark for confirmation 17*b*. With such a configuration, the positioning marks 17 (17*a*, 17*b* ) are put in a state where they are integral with the pattern 15, so that the positioning marks 17 are prevented from injuring the design of the can body 10.

In the can barrel 11, 11' shown in FIGS. 2 and 3, forming positions of the mark for stop 17*a* and the mark for confirmation 17*b* should be provided at portions having a higher circularity. It is preferable to provide the marks 17 near the neck portions 11*a*, 11*a*' or the can bottoms 11*b*, 13 which have small variation in shape in the can barrel 11. Also, it is preferable to print the positioning marks 17 simultaneously with the pattern printing because the number of steps is not increased.

Figure 4:
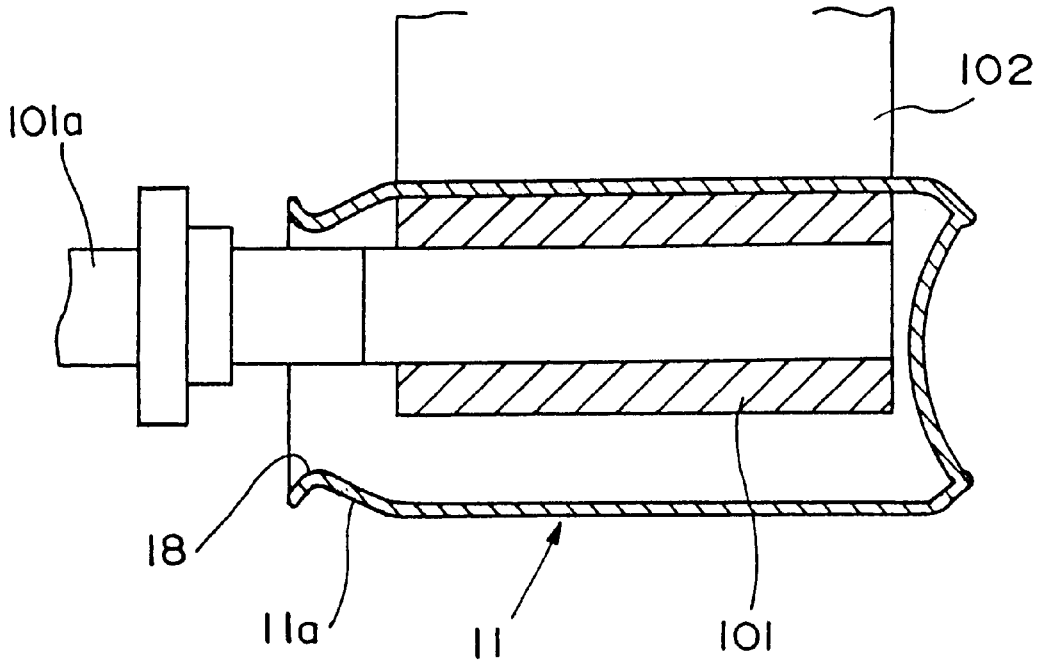
FIG. 4 is a sectional view showing a relationship among an inner roller, an outer roller and a can barrel during embossing.

Next, the procedure for performing embossing on the can barrel will be explained with reference to FIG. 4, FIG. 10 and FIG. 11.

First, a configuration of the forming apparatus for an embossed can body to which the manufacturing method of the present invention is applied will be explained with reference to FIG. 11.

The forming apparatus for an embossed can body has frames 111 and 112 arranged at left and right ends, and a rotating shaft 110 which is rotatably supported by the frames 111, 112. Fixed to one end (right end in FIG. 11) of the rotating shaft 110 is a driving gear 113. The driving gear 113 meshes with driving means (not shown), and the rotating shaft 110 is rotated when the driving means is driven.

Mounted to the other end side of the rotating shaft 110 are a fixed gear 114 and a first rotating member 115 concentrically with the rotating shaft 110.

Supported at a peripheral edge portion of the first rotating member 115 are a plurality of sets of an inner roller shaft 101*a* and an outer roller shaft 102*a*. Provided at a right end of the inner roller shaft 101*a* is an inner roller 101, and provided at a right end of the outer roller shaft 102*a* is an outer roller 102.

An inner roller gear 116 meshing with the fixed gear 114 is fixed to the left end of the inner roller shaft 101*a*. An outer roller gear 118 meshing with an intermediate gear 117 fixed to the inner roller shaft 101*a* is fixed to the left end of the outer roller shaft 102*a*.

Thereby, the inner roller shaft 101*a* and the outer roller shaft 102*a* paired are rotated by power from the same driving system, and the rotations thereof are always synchronized under a fixed relationship.

A recess portion corresponding to the pattern (CAN) is formed on an outer surface of the inner roller 101. On the other hand, the outer roller 102 is formed as a cam comprising a combination of a large diameter portion and a small diameter portion. A projection portion having the same shape (CAN) as the recess portion of the inner roller 101 is formed on the large diameter portion. Then, the recess portion and the projection portion are paired to form forming dies (forming means).

A second rotating member 119 is mounted integrally to the first rotating member 115. Can barrel holding means 120 is arranged on a peripheral surface of the second rotating member 119 and at a portion positioned to the right side of the inner roller 101.

The can barrel holding means 120 comprises a sliding body 122 slid along a slide guide 121 formed on the second rotating member 119, a swinging body 125 provided to a supporting body 123 fixed to the sliding body 122 swingably about a shaft 124, a can bottom chuck 126 rotatably supported to the left side of the swinging body 125, a stepping motor 129 for rotating the chuck 126, a can barrel mounting roller 127 rotatably mounted to a roller supporting member 127*a* provided in a projecting manner to the left side of the swinging body 125, a cam roller 128 mounted to the right side portion of the swinging body 125, and the like.

A fixing member 130 is disposed to the right side of the second rotating member 119 and fixed to the frame 112. A cam groove 131 is formed on a peripheral side surface of the fixing member 130. The can groove 131 is formed at a position (a position where the inner roller 101 is inserted to the can barrel 11 on the can barrel mounting roller 127) near the inner roller 101 in the range of (3) to (9) in FIG. 10. Also, the cam groove 131 is formed at a position (a position where the inner roller 101 comes off from the can barrel 11 on the can barrel mounting roller 127) separated from the inner roller 101 in a range except for the above range.

Incidentally, the cam groove 131 with a locus corresponding to movement of the can barrel is formed at a portion connecting the position near the inner roller 101 and the position separated from the inner roller 101.

A cam roller 133 rollably fitted in the cam groove 131 is mounted to the right end of the connecting body 132. The connecting body 132 is fixed at its left portion to the sliding body 122. Accordingly, when the locus of the cam groove 131 changes, the connecting body 132 is moved right and left according to the change.

Figure 10:
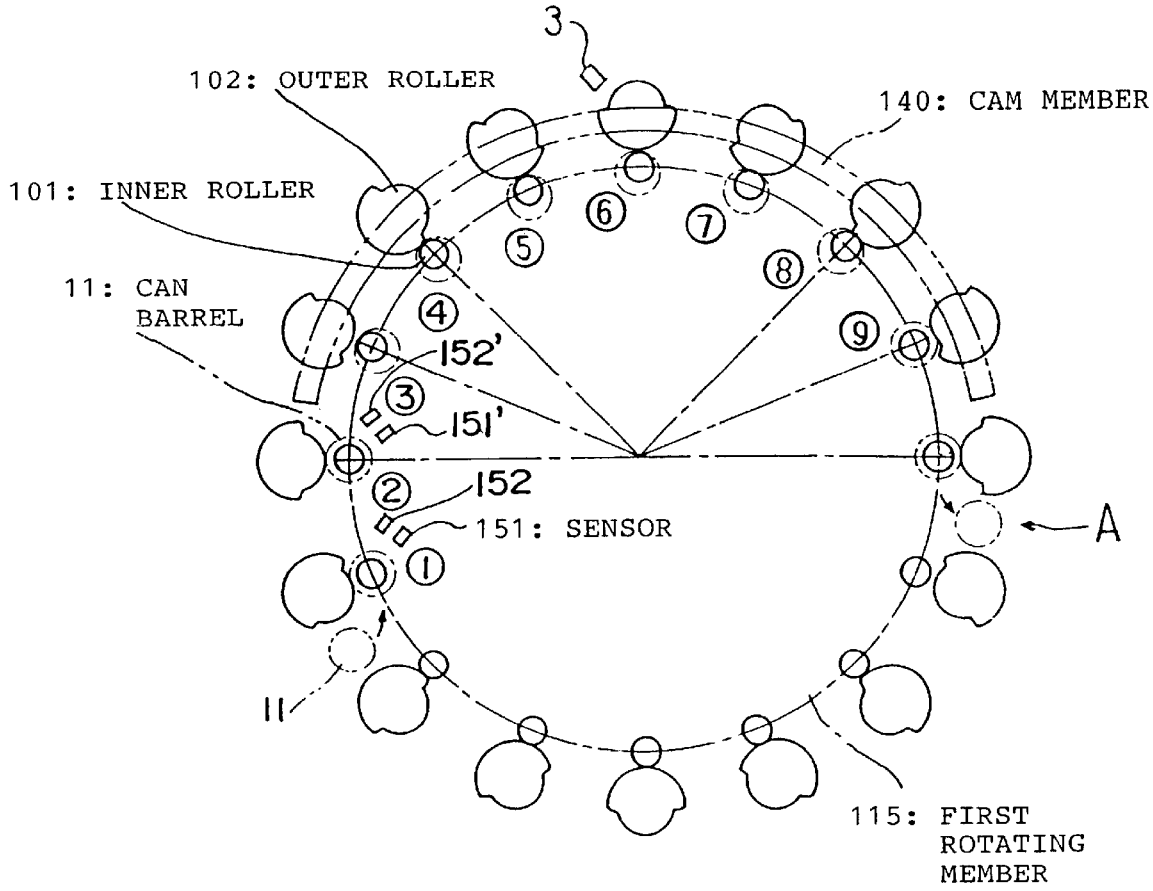
FIG. 10 is a diagram for explaining procedure for performing embossing on a can barrel.

As shown in FIG. 10, a cam member 140 is arranged outside the inner rollers 101 over a range slightly wider than the range of (3) to (9). The arrangement position of the cam member 140 is the same position as the position of the cam roller 128 provided at the swinging body 125 in a state where the swinging body 125 is moved to the left side by the cam groove 131 and the inner roller 101 is inserted into the can barrel 11 on the can barrel mounting roller 127.

Also, the cam member 140 presses the cam roller 28 in the range of positions (4) to (5) in FIG. 10 to swing the swinging body 125 about the shaft 124 in the direction of the rotating shaft 110. Thereby, the can barrel wall positioned to the side contacting with the outer roller 102 is pressed on to the inner roller 101.

Incidentally, the basic structure of the forming apparatus which has been described until now is the same as the technique of Japanese Patent Application Laid-Open No. 9-192763 which is an application of the present applicant.

In the embossing apparatus thus configured, embossing is performed on the pattern portion by the inner roller 101 inserted into the can barrel 11 and the outer roller 102 disposed outside the can barrel 11 while the can barrel 11 is being fed along the circular periphery.

The procedure for the embossing will be explained with reference to FIG. 10.

Figure 1:
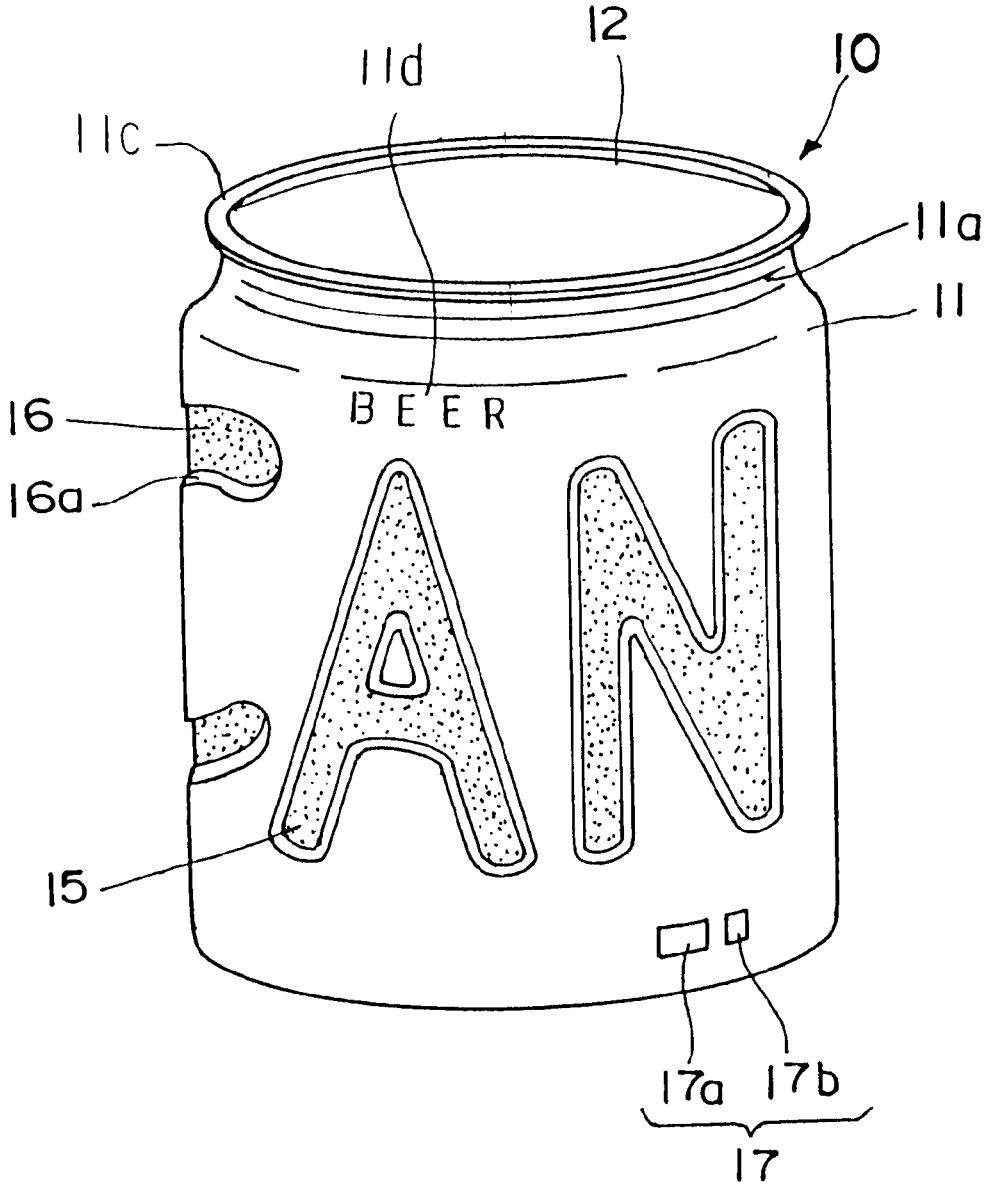
FIG. 1 is a perspective view of an embossing can body which is applied with a manufacturing method of the present invention.

The can barrel 11 is introduced from the position shown with (1) in FIG. 10. The neck portion 11*a* which is the plastically deformed portion is formed in advance on the can barrel 11, as shown in FIG. 1. In the can barrel 11 which has been introduced into the embossing apparatus, detection of the positioning marks 17 formed on the can barrel 11 is performed at the turret positions (1) and (2) by sensors 151, 152, 151', 152', . . . (sensors disposed in the other pockets are not shown) or the like disposed in respective pockets.

The sensors 151, 151', . . . detect the mark for stop 17*a* of the can barrel 11 and the can barrel 11 is rotated such that the pattern 15 is directed to a predetermined position (a position where the recess portion and the projection portion of the forming dies are coincide with each other). Next, the sensors 152, 152', . . . detect the mark for confirmation 17*b* and it is judged whether or not the pattern 15 is directed to the predetermined position.

In this time, since plastic deformation is performed on the can barrel 11 to form the neck portion 11*a* and the flange portion 11*c* in advance, the can barrel 11 is kept in a substantially circular shape, and the positioning marks 17 can be detected accurately even when the can barrel 11 is rotated at a high speed.

Thereafter, when the positioning marks 17 are detected, the can barrel 11 is sent up to the position shown with (3) in FIG. 10, while the attitude detected is maintained, and the inner roller 101 is inserted into the can barrel 11 between the positions (2) and (3). Incidentally, the diameter of the inner roller 101 is formed so as to be smaller than the inner diameter of the neck portion 11*a*.

Also, the cam member 140 is disposed outside the inner roller 101 over a range slightly wider than the range of (3) to (9). The cam member 140 presses the inner wall of the can barrel 11 positioned at the side contacting with the outer roller 102 over the range of (4) to (8) to the inner roller 101 by pressing an outer periphery of the can barrel 11 by the outer roller 102.

Embossing is performed on the can barrel 11 in the range of (4) to (8) while the inner roller 101 and the outer roller 102 are being rotated. As shown in FIG. 1, since the neck portion 11*a* has been formed on the can barrel 11 in advance, when embossing is performed on one portion of an outer periphery of the can barrel 11, the height of the opening peripheral edge of the can barrel 11 can be prevented from being made uneven. Also, since the neck portion 11*a* has been formed prior to embossing, or necking work has been performed prior to embossing, there is no drawback that wrinkles occur in the can barrel 11.

When the can barrel 11 is sent up to the position (9) shown in FIG. 10, the pressing of the cam roller (not shown) effected by the cam member 40 is released and the inner roller 102 comes off from the can barrel 11. The can barrel 11 is conveyed at the position A shown in FIG. 10 out of the embossing apparatus.

Thus, the working for the recess portion 16 is performed on the pattern portion of the can barrel 11.

Incidentally, the above embossing procedure is applicable to not only the two pieces can shown in FIGS. 1 and 2 but also the three pieces can shown in FIG. 3.

[Inspecting apparatus for an embossed can body]

Next, an inspecting apparatus for an embossed can body of the present invention will be explained with reference to FIGS. 5 to 10.

Figure 11:
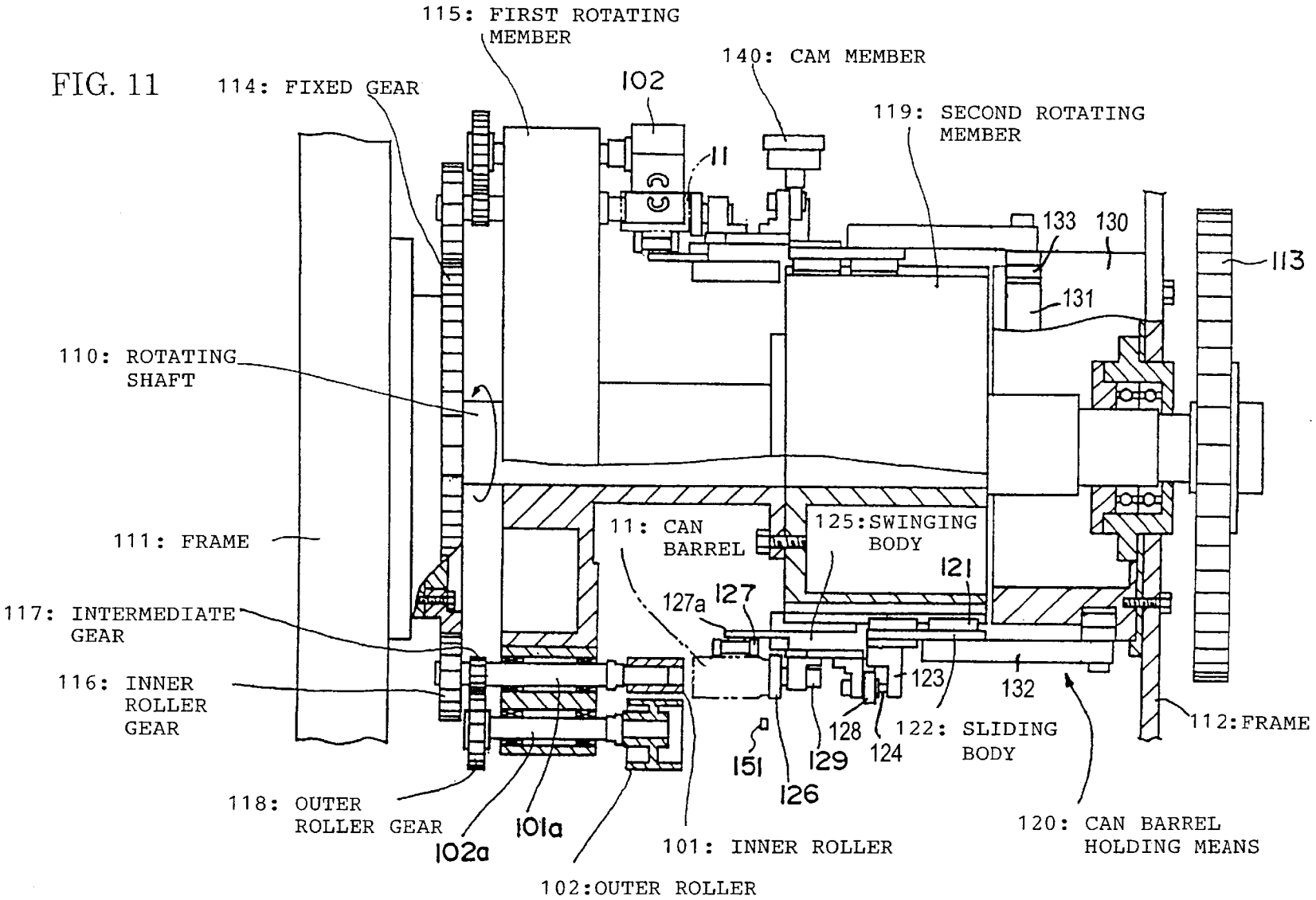
FIG. 11 is a sectional view for explaining a configuration of a forming apparatus for an embossed can body.
Figure 12:
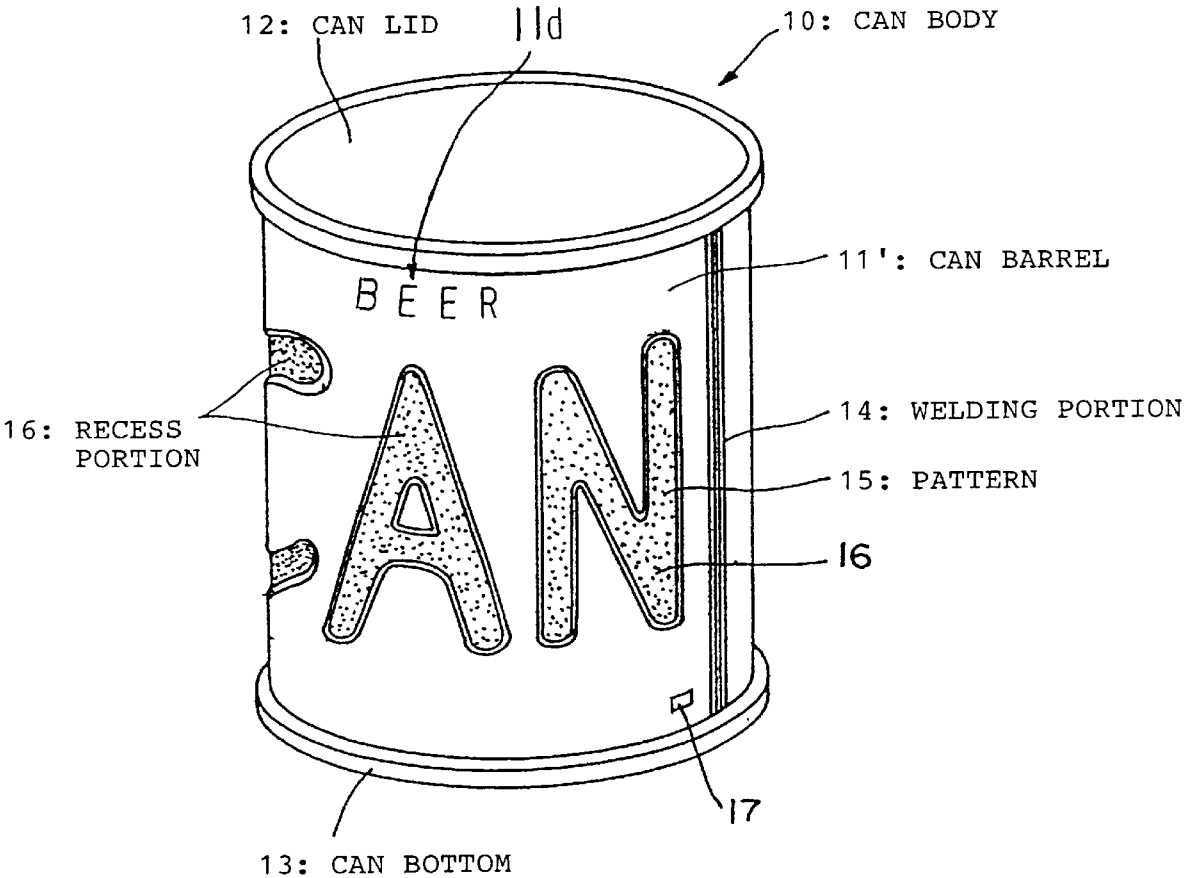
FIG. 12 Prior Art
FIG. 12 is a perspective view showing one example of a can body according to a conventional art relating to the present invention.
Figure 13:
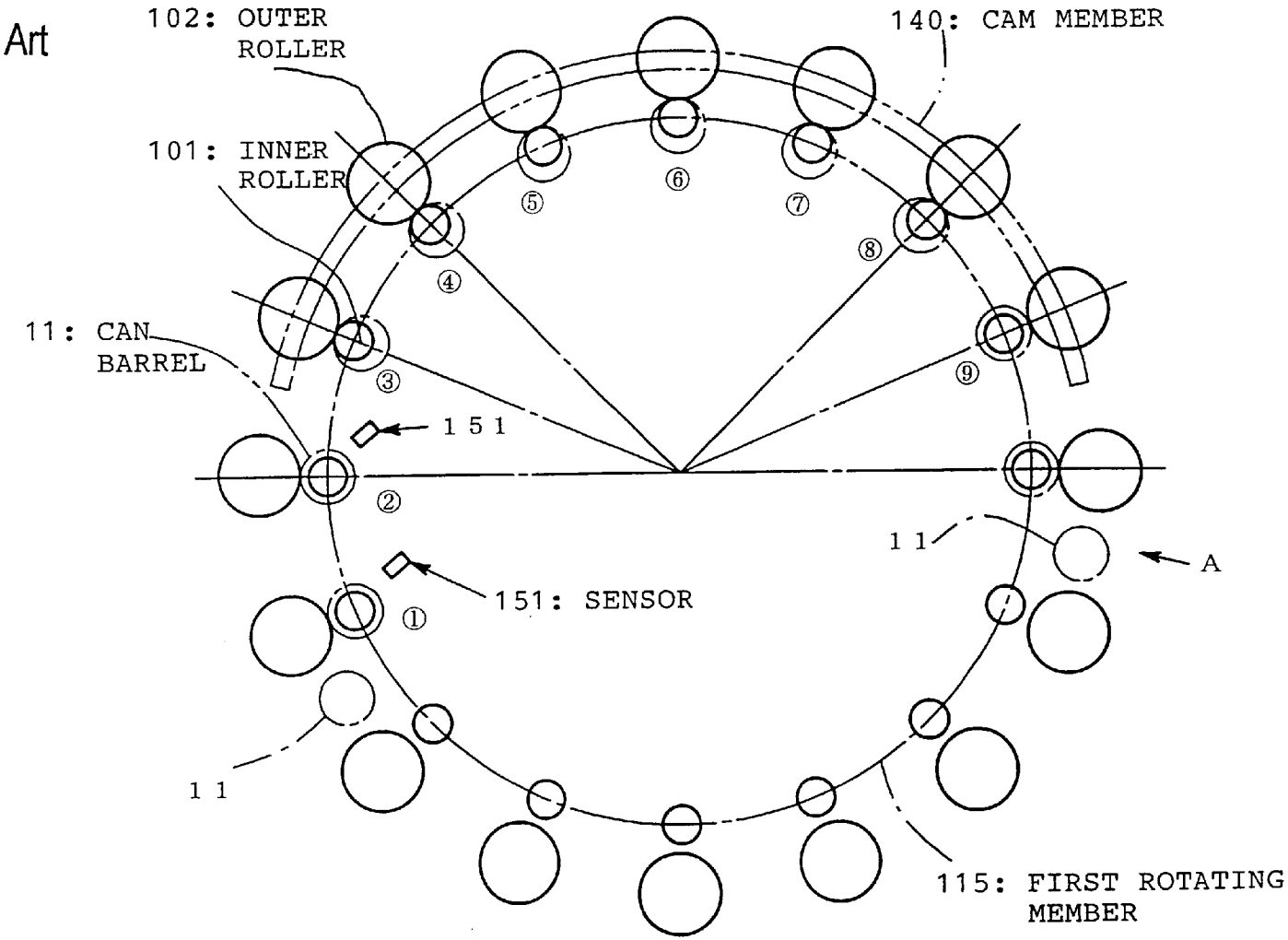
FIG. 13 Prior Art
FIG. 13 is a diagram for explaining procedure for performing recess/projection working on a can barrel by a rotary type embossing apparatus and embossing method according to a conventional art relating to the present invention.

It is to be noted that the embossing apparatus to which the inspecting apparatus is applied is the same as shown in FIG. 11.

Figure 5:
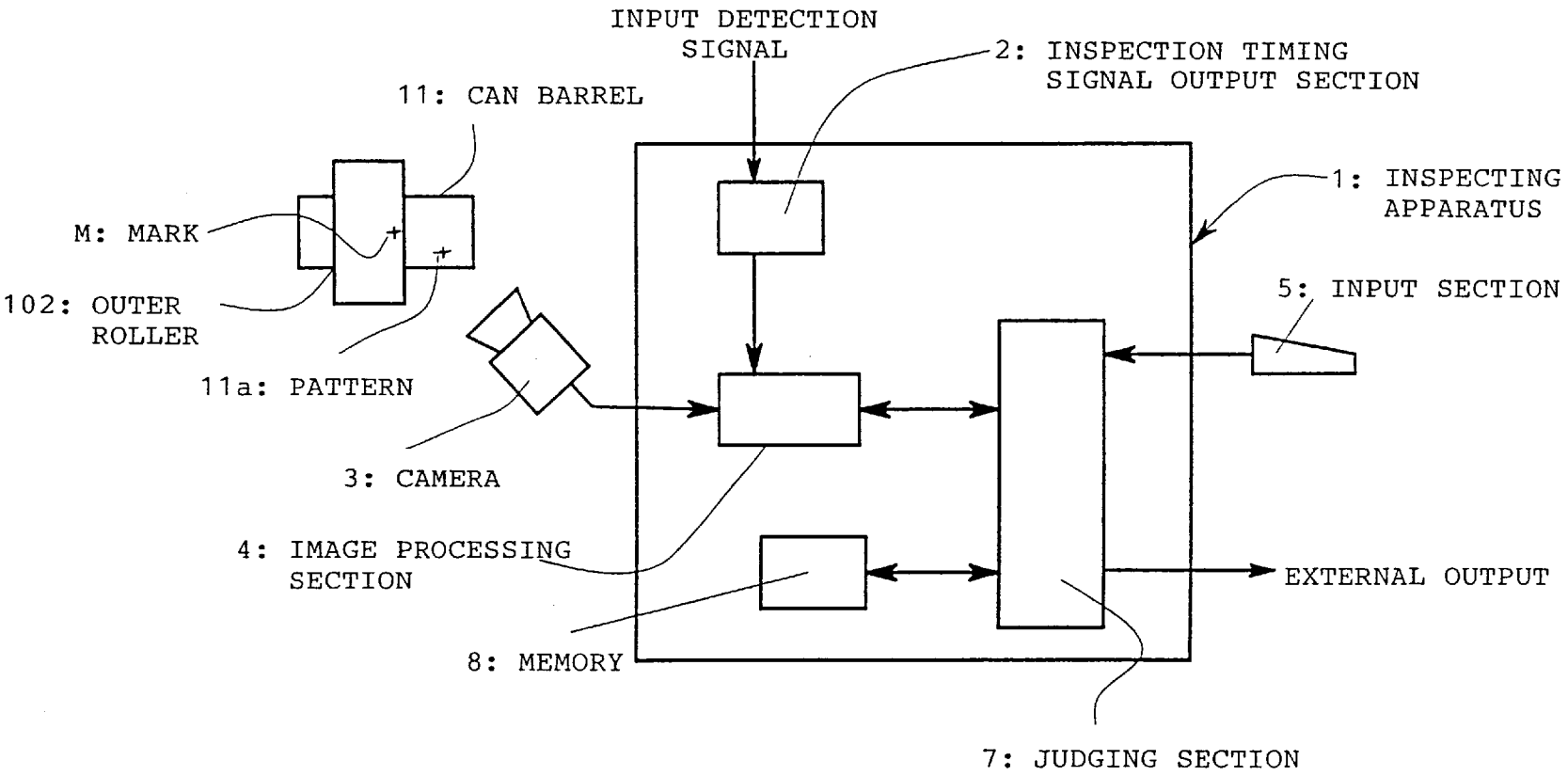
FIG. 5 is a block diagram explaining a configuration of an inspecting apparatus for a can body.
Figure 6:
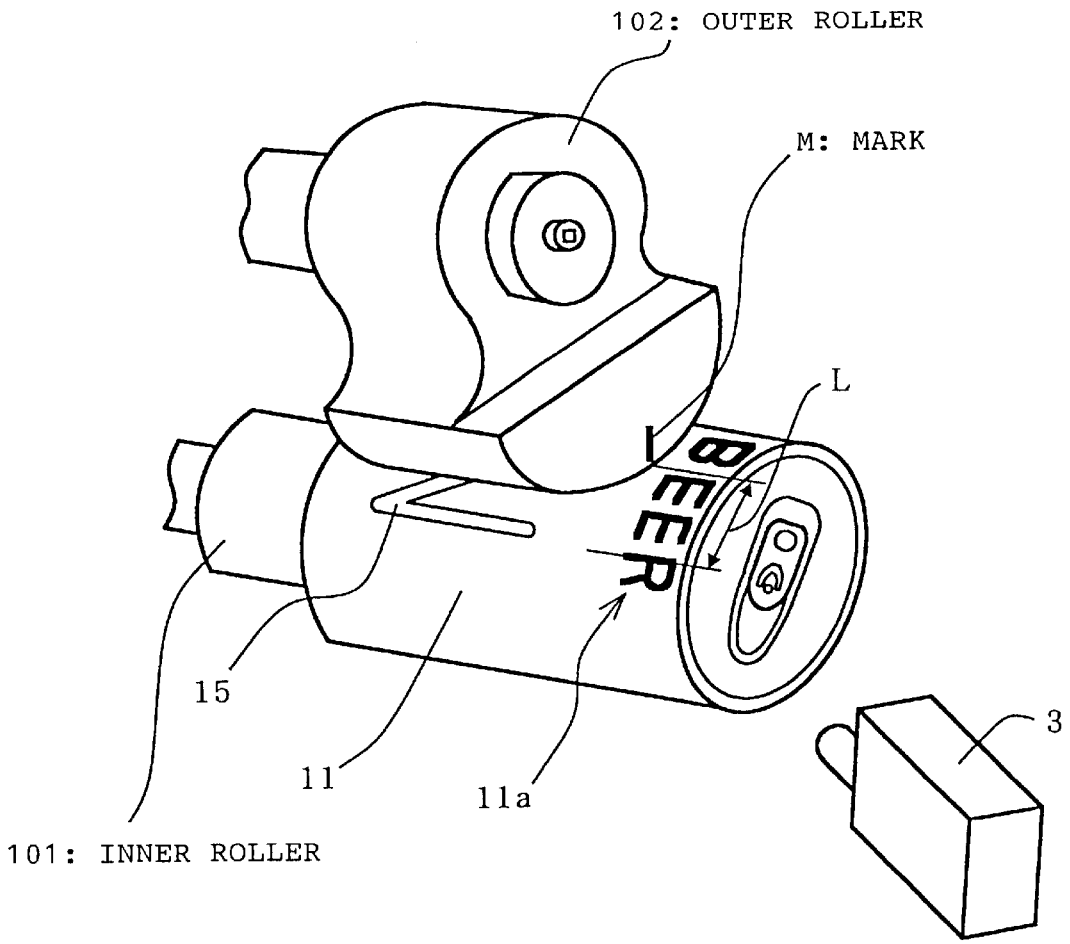
FIG. 6 is a perspective view showing a positional relationship between an can barrel and an outer roller during recess/projection working.
Figure 7A:
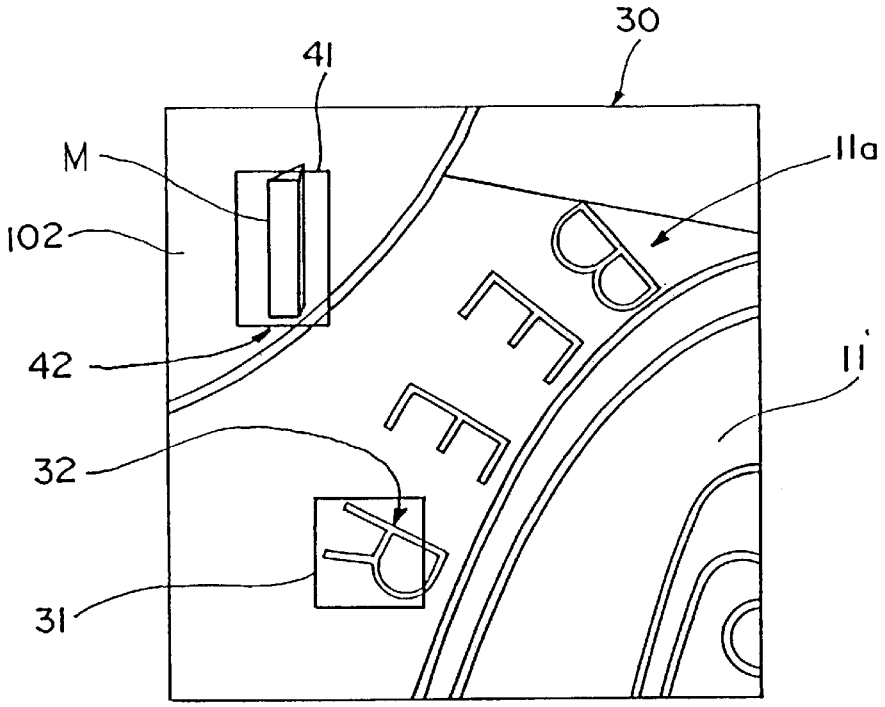
FIGS. 7(*a*) and 7(*b*) are diagrams showing images which have been photographed by a camera.
Figure 7B:
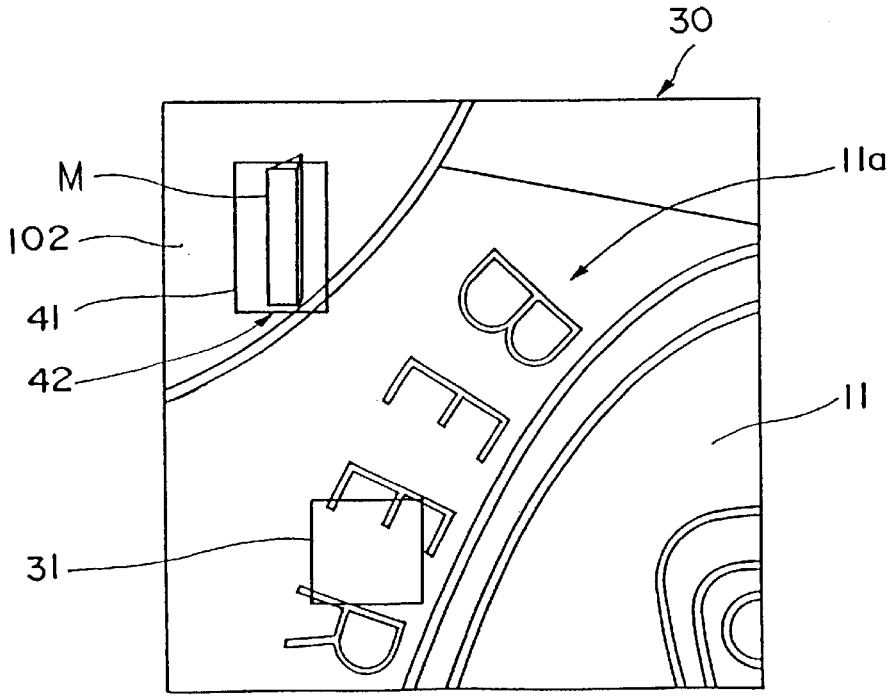

FIG. 5 is a block diagram for explaining a configuration of the inspecting apparatus for a can body, FIG. 6 is a perspective view showing a positional relationship between a can barrel during recess/projection working and an outer roller, and FIGS. 7(*a*) and 7(*b*) are diagrams showing an image which has been photographed by a camera.

As illustrated, the inspecting apparatus 1 comprises a camera 3 for photographing the pattern 11*d* (refer to FIG. 3) portion provided to the can barrel 11, an image processing section 4 for processing an image photographed by the camera 3, a switch (not shown) which serves as inspection timing detecting means and which is switched by a cam or the like rotated in synchronism with rotation of the outer roller 102, an inspection timing signal output section 2 for outputting an inspection timing signal to the image processing section 4 when the detection signal is input from the switch, a judging section 7 for processing the result obtained from the image processing section 4 when the inspection timing signal is output and for judging whether the result of working indicates a good product or a bad product on the basis of the result, and a memory 8 for storing various set contents which have been set in advance. Inputting to the memory 8 or the like can be performed by operation of an input section 5 such as a keyboard.

The switch may be structured such that a timing signal can be detected in synchronism with rotation of the outer roller 102. Besides such an electrical switch as a photo-electric switch or the like, such a mechanical switch as a micro-switch or the like can be used as this switch.

The camera 3 for photographing the can barrel 11 is disposed in a midway of the recess/projection working, or at the turret position (6) in FIG. 10.

Incidentally, the camera 3 may be structured such that a positional deviation between the working position of the recess/projection work and the pattern 15 (refer to FIG. 3) of the can body 10 can be inspected. The camera 3 may be disposed at any one of the turret positions (4) to (8), (9) and the discharging position A. In the turret positions (5) to (7) in FIG. 10, the can barrel 11 is strongly clamped by the outer roller 102 and the inner roller 101, so that movement and rotation of the can body 10 relative to the inner roller 101 are restrained. For this reason, it is preferable that the camera 3 for inspection is disposed at this position, because a positional deviation between the working position of the recess/projection work and the pattern 15 of the can body 11 can be inspected accurately.

Also, the camera 3 may be structured such that a particular region can be extracted or a pattern can be recognized by processing the photographed image at the image processing section 4. A CCD camera or the like which transmits the photographed image to the image processing section 4 as binary data can be used as the camera 3. The camera 3 is positioned and securely fixed to a frame or the like of the forming apparatus for a can body such that a photographing position is not changed easily due to vibrations during recess/projection working.

The image processing section 4 processes image data transmitted from the camera 3. When an inspection timing is input from the inspection timing signal output section 2, an image 30 obtained when the inspection timing signal has been input, such as shown in FIG. 7, is sent to the judging section 7 as binary data.

In the judging section 7, a selection region 31 is set to a predetermined position according to the procedure which has been stored in the memory 8, a portion of the pattern 11*d* from the selection region 31 is extracted (refer to FIG. 7), and the image information is produced. The image information can be produced on the basis of arrangement of white and black (light and dark) of pixels in the selection region 31.

Also, the judging section 7 retrieves a mark M (which is provided to the outer roller (refer to FIG. 6)) which has been set in advance and stored in the memory 8 from the image 30. The detection of the mark M can be performed on the basis of arrangement information of white and black (light and dark) of pixels in a selection region 41 like the above explanation. When existence of the mark M can not be detected, an output signal indicating a bad product is transmitted to a control section of the forming apparatus for a can body (not shown).

Also, the judging section 7 compares one portion (hereinafter, called as extracted pattern) of the pattern 11*d* taken out from the selection region 31 and a reference pattern which has been stored in the memory 8 in advance with each other in order to judge whether both are the same, so that it is judged whether or not the can barrel 11 is mounted on the inner roller 101 and it is judged whether or not there is a positional deviation of the can barrel 11 to the outer roller 102, and therefore to the inner roller 101.

For example, as shown in FIG. 7(*b*), when a character "E" is positioned at a position where a character "R" should be positioned originally due to that the can barrel 11 is rotated relative to the inner roller 101, the pixel arrangement in the selection region 31 in the image 30 which has been photographed by the camera 3 is different from that in FIG. 7(*a*). From this, it can be judged that the can barrel 11 has been rotated relative to the inner roller 101 or the like.

As the comparison result thus obtained, in a case that the extracted pattern and the reference pattern coincide with each other or even if there is some deviation therebetween, the deviation is in a predetermined allowable range which has been set in the memory 8, the both are judged as "the same".

When the amount of the deviation between the both is out of the allowable range, an output signal indicating a bad product is transmitted to the control section of the forming apparatus for a can body (not shown).

When the judging section 7 judges that the reference pattern which has been set in the memory 8 in advance and the extracted pattern which has been taken out from the image processing section 4 are identical, the following inspection processings are performed.

First, a first reference position 32 is set on the basis of the image information regarding the extracted pattern which has been sent from the image processing section 4. The first reference position 32 must be set to all 16 turret positions under the same condition. However, it is not required necessarily to set the first reference position 32 in the pattern 11*d*. It is possible to set the position at any position such as a center of the selection region 31. In this embodiment, the first reference position 32 is set to a linear portion of a character "R", as shown in FIG. 7(*a*).

Also, when the judging section 7 judges that the mark M exists at the predetermined position in the screen 30, a second reference position 42 is set on the basis of the image information of the mark M transmitted from the image processing section 4. If the second reference position 42 is set to all 16 turret positions under the same condition like the first reference position 32, the setting position of the mark M can be determined arbitrarily. In this embodiment, the second reference position 42 is set at a lower end of the mark M.

Furthermore, the judging section 7 processes the image information which has been transmitted from the image processing section 4 and indexes coordinate positions of the first reference position 32 and the second reference position 42. Then, the distance between the first reference position 32 and the second reference position 42 is obtained. Furthermore, the distance L between the first reference position 32 and the second reference position 42 is compared with the value regarding the distance which has been stored in the memory 8 in advance.

Thereby, it can be judged whether the positional relationship of the can barrel 11 to the outer roller 102 is proper. When the distance L is out of the allowable range, an output signal indicating a bad product is transmitted to the control section of the forming apparatus for a can body (not shown).

[Inspecting method for an embossed can body]

Next, one embodiment of an inspecting method of the present invention will be explained together with operation of the above-mentioned inspecting apparatus.

Figure 8:
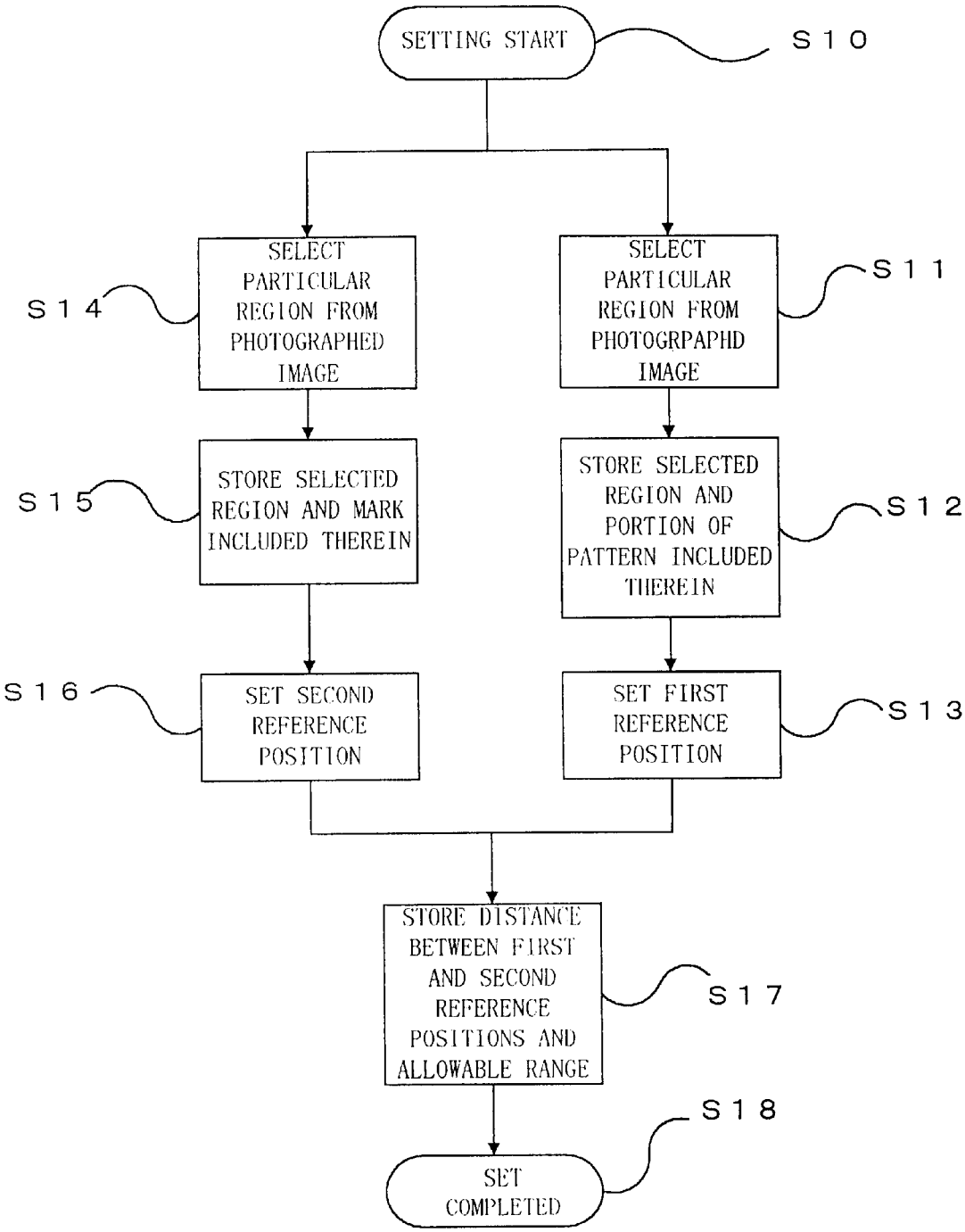
FIG. 8 is a flowchart according to an embodiment of an inspecting method of the present invention, which shows procedure for setting various reference values before recess/projection working starts.
Figure 9:
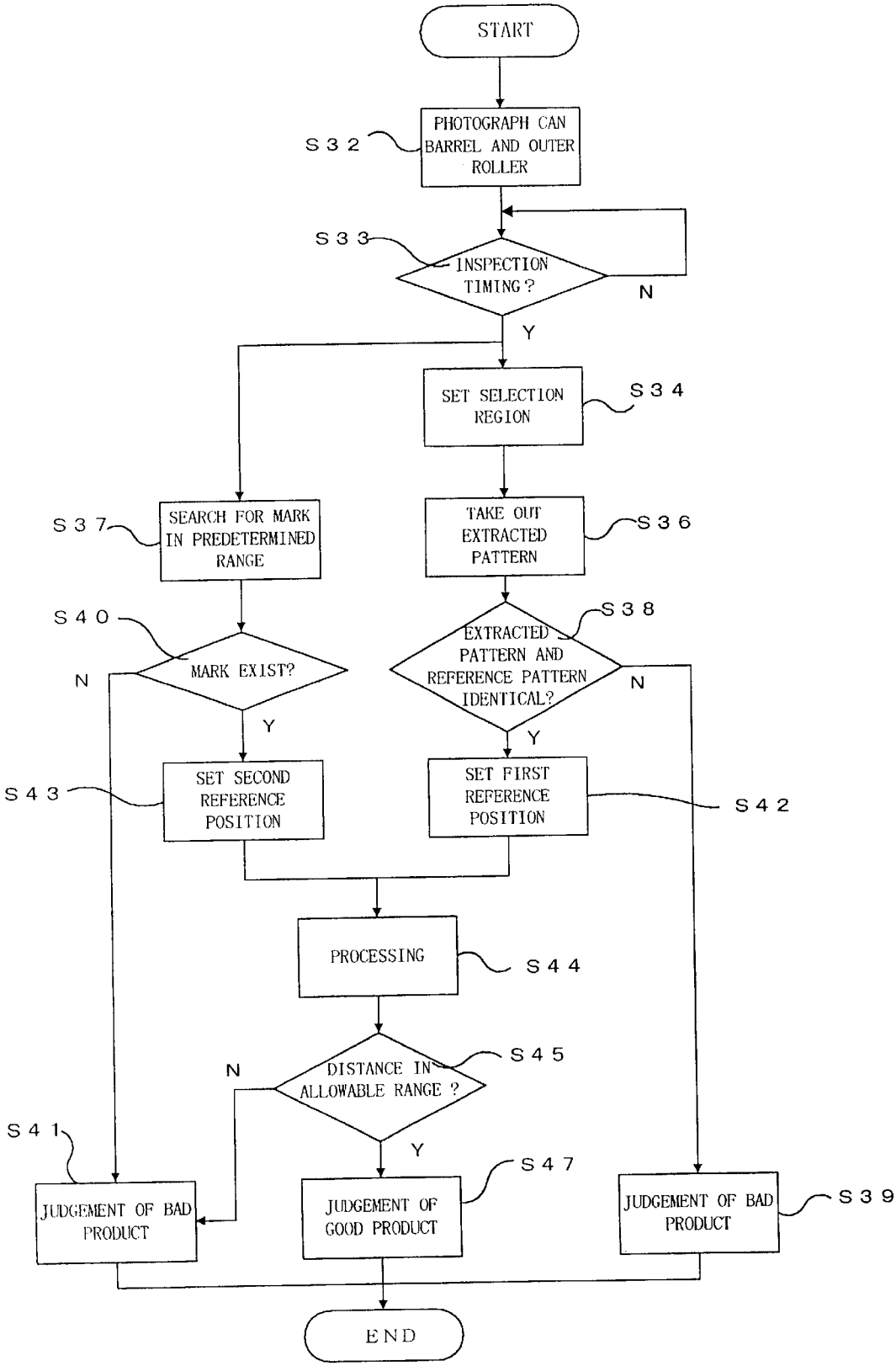
FIG. 9 is a flowchart according to the embodiment of the inspecting method of the present invention, which shows inspecting procedure when recess/projection working is performed.

FIGS. 8 and 9 are flowcharts according to the embodiment of the inspecting method of the present invention. FIG. 8 shows a procedure of setting various reference values before a recess/projection work starts, and FIG. 9 shows a procedure of inspection when the recess/projection work is performed.

First, the procedure of setting various reference values will be explained according to FIG. 8.

First, the can barrel 11 and the outer roller 102 which serve as references are positioned accurately at the position (6) shown in FIG. 10 where the camera 3 is disposed. A state where a detection signal is input from the switch and an inspection timing signal is output from the inspection timing signal output section 2. Setting starts in this state.

With setting start (Step S10), a portion which is considered to be most preferable for inspection is selected from the image of the pattern 11*a* of the can barrel 11 which is photographed by the camera 3 (Step S11). In the example shown in FIG. 7(*a*), the character "R" is selected from the characters "BEER", and a region portion which can securely be discriminated from the remaining characters "B" and "E" is selected. The region thus selected is the selection region 31.

Incidentally, as the selection region 31 is made larger, the discrimination can be performed more securely. However, according to increase in area of the selection region 31, the amount of data to be processed is increased, and the processing time is also increased. For this reason, it is preferable to select the selection region 31 in a range where the selected region can securely be discriminated from the other pattern as narrow as possible.

The selection region 31 thus selected and a portion of the pattern 11*d* included in the selected region 31 are stored in the memory 8 as a pattern (hereinafter, called as reference pattern) which serves as a reference for inspection (Step S12). At this time, it is preferable to perform setting with an allowable range added taking into consideration the holding positions of the can barrel 11 in the respective turret positions when the recess/projection work is performed, the deviation in printed position of the pattern 11*d* for each can barrel 11 or the like.

When the reference pattern is determined in this manner, the first reference position 32 is set according to the predetermined procedure on the basis of the reference pattern (Step S13). The first reference position 32 can be obtained, for example, by substituting arrangement data of white and black (light and dark) of the reference pattern in the selection region 31 for a predetermined condition equation.

With the above procedure, setting the can barrel 11 side is completed. Then, setting the outer roller 102 is performed.

A portion including the mark M is selected from the image 30 (Step S14). At this time, it is preferable to select the portion such that the mark M is positioned at an approximately central portion of the selected range. The range thus selected is a range where it is retrieved whether or not the mark 102*a* exists during the recess/projection work. Since this range serves as a reference for judging whether or not the recess/projection work and the pattern 15 of the can body 10 coincide with each other, it is preferable to reduce this range as narrow as possible in view of the deviations of each outer roller 102 at the 16 turret positions.

The information regarding the mark M included in the range thus selected is stored in the memory 8 (Step S15). The information is used when the judging section 7 searches for the mark M.

Next, the second reference position 42 is set according to a predetermined procedure on the basis of the mark M (Step S16). The second reference position 42 can be obtained by substituting arrangement data of white and black (light and dark) of the mark M in the selection region 41 for a predetermined condition equation like the first reference position 32. The condition equation which has been used for setting the first reference position 32 may be used for the condition equation for the second reference position 42.

Finally, the distance L between the first reference position 32 and the second reference position 42 set in the above manner is obtained, and it is stored in the memory 8 as a reference distance for inspection (Step S17). Incidentally, it is preferable that an allowable range is predetermined for the distance L in view of the deviation for each turret position and the distance L together with the allowable range is stored in the memory 8.

These settings can be performed by operation of the input section 5.

The setting procedure for various setting values is completed according to the above procedure (Step S18).

Next, the inspection procedure in performing the recess/projection work actually will be explained according to the flowchart shown in FIG. 9 with reference to FIGS. 5 to 8, and FIG. 10.

At the turret position (6) in FIG. 10, the can barrel 11 and the outer roller 102 are photographed by the camera 3 (Step S32).

An inspection timing signal is output from the inspection timing signal output section 2 by detection of the timing mark effected by the switch (Step S33). The selection regions 31, 41 are respectively set to predetermined positions in the image 30 (refer to FIG. 7(*a*)) which has been photographed by the camera 3 according to the stored contents set in the memory 8 (Step S34).

By setting the selection region 31, a portion of the pattern 11*d* included in the selection region 31 is taken out as the extracted pattern in a form of binary data (Step S36).

In the judging section 7, as described above, it is judged whether or not the reference pattern which serves as the reference and which has been stored in the memory 8 and the extracted pattern coincide with each other or whether or not the both are the same on the basis of whether or not the deviation therebetween, if any, is in the allowable range which has been set in the memory 8 in advance (Step S38). When it is judged that the both are not the same, the product is determined as a bad one and inspection is not performed hereinafter (Step S39).

In the judging section 7, search is performed about whether or not the mark M exists in the selection region 41 (Step S37), and when it is judged that the mark M does not exist in the selection region 41 (Step S40), the product is determined as a bad one and inspection is not performed hereinafter (Step S41).

When the reference pattern which has been stored in the memory 8 and the extracted pattern which has been taken out by the image processing section 4 are identical, the judging section 7 sets the first reference position 32 from the extracted pattern which has been taken out according to the procedure which has been set in the memory 8 in advance (Step S42).

Also, when it is judged that the mark M exists in the selection region 41, the judging section 7 sets the second reference position 42 from the selection region 41 according to the procedure which has been set in the memory 8 in advance (Step S43).

The coordinate positions of the first reference position 32 and the second reference position 42 thus set are obtained in the judging section 7. Then, the distance L between the both positions 32, 42 is calculated from the coordinate positions obtained (Step S44). The distance L obtained is compared with the distance L which serves as a reference and which has been set in the memory 8 in advance and the allowable range thereof (Step S45).

As a result, when it is judged that the distance L is in the allowable range, the product is determined as a good one (Step S47), and an output signal is transmitted to the control section of the forming apparatus for a can body (not shown). When it is judged that the distance L is out of the allowable range, the product is determined as a bad one (Step S41), and after it is discharged from the discharging position A shown in FIG. 10 outside the apparatus, it is removed as the bad product from the working line.

In the followings, the inspection is repeated by repetition of the above steps.

Incidentally, since the processing based on the above Steps S32 to S47 is performed on the time order of several tens ms in the inspecting apparatus 1 shown in FIG. 5, it can accommodate a high speed work such as several hundreds cans per min.

The inspecting apparatus and method of the present invention are not limited to the above embodiments.

For example, in the above explanation, the present invention has been explained such that the pattern 11*d* of the can body 10 and the mark M of the outer roller 102 are photographed by one camera 3, but it can be structured such that the pattern 11*d* and the mark M are respectively photographed by different cameras.

Also, the present invention has been explained such that the mark M is extracted from the photographed image of the camera 3, and the second reference position 42 is set in the mark M. However, when the deviations of the outer roller 102 and the position of the mark M for each turret position are small, the present invention can be structured such that the second reference position 42 is set to any position on the forming apparatus for a can body in advance and the coordinate position thereof is stored in the memory 8.

Furthermore, in the above embodiment, the character has been explained as one example for the pattern 11*d* for inspection, but the pattern is not limited to the character. The pattern may be formed as a pattern defined by a line or by a line and color. Particularly, a color photographing camera which can discriminate colors is used as the camera 3 for photographing the can barrel 11 and the image processing section 4 which allows color recognition is employed, so that it becomes possible to detect rotation of the can barrel 11 or the positional deviation to the outer roller 102 according to the position where the colors are changed.

Also, the present invention has been explained such that the pattern which serves as the reference for inspection and which has been photographed by the camera 3 is the character "R" in the pattern 11*d* "BEER". However, the pattern which serves as the reference for inspection is not limited to this. The other patterns can be used for the reference, and the pattern can be selected from the pattern 15 to be subjected to recess/projection work.

Furthermore, in the above embodiment, it is judged from the photographed image of the camera 3 whether or not the can barrel 11 is mounted on the inner roller 101. However, the present invention may be structured such that detecting means for detecting whether or not the can barrel 11 is mounted on the inner roller 101 prior to performing recess/projection work (for example, the turret position (5) in FIG. 10) is provided so that, when the can barrel 11 is not mounted to the inner roller 101, inspection for recess/projection work of the can barrel 11 is not carried out.

According to the method for manufacturing an embossed can body of the present invention, an embossed can body having a high quality can be obtained where variation in sectional configuration of each can barrel is made much small, positioning a pattern is securely performed at a high speed working, deviation of set position of a can barrel to a forming apparatus is prevented, and the pattern coincides with a recess/projection working portion.

In particular, by embossing a can barrel after a neck portion is formed at a peripheral edge of an opening portion of the can barrel, wrinkles can be prevented from occurring on the neck portion due to material drawing-in when embossing, and variation in height of the opening peripheral edge can be suppressed.

Also, by providing a plurality of positioning marks as mentioned above, even when dirt or dusts are stuck to a can barrel or a can barrel has a welded portion, it is possible to securely position a pattern portion to be subjected to one or both of a recess portion and a projection portion working to a position corresponding to a forming apparatus.

Furthermore, according to the inspecting apparatus and the inspecting method of the present invention, in a case that recess/projection work is performed so as to correspond to a pattern of a can barrel, since it is possible to inspect whether or not the pattern and the recess/projection work coincide with each other at a high speed and securely, a higher speed in recess/projection working can be attained.

Also, since a dedicated step for performing such an inspection is not required, the number of steps from introduction of a can body into a forming apparatus for a can body to discharge of the can body can be reduced.

Accordingly, it is possible to inspect a can body securely to stabilize the quality of the can body even at a high speed working such as several hundreds cans per min.

INDUSTRIAL APPLICABILITY

The present invention is applicable to not only manufacture of cans for drink such as beer, juice or the like, but also manufacture of cans of any kinds filled with foods, fats and oils, aerosols, and various gasses.

What is claimed is:

1. A method for manufacturing an embossed can body including a pattern printed on an outer surface of a cylindrical can barrel and an embossed portion formed on at least a part of the pattern so as to be aligned with the pattern, comprising, providing on the cylindrical can barrel a stopping mark for stopping the can body, which is being rotated, to face a predetermined direction, and a confirmation mark for confirming whether or not the pattern faces a predetermined direction when the can body is stopped, arranging a pair of sensors formed of a first sensor corresponding to the stopping mark and a second sensor corresponding to the confirmation mark, said first and second sensors being located near a portion where the can barrel is stopped, and judging that the pattern on the can barrel is oriented in a predetermined direction when the respective first and second sensors detect the stopping mark and the confirmation mark.

2. A method for manufacturing an embossed can body according to claim 1, wherein the can barrel has a welded line, said stopping mark being formed to be longer than a width of the welded line.

3. A method for manufacturing an embossed can body according to claim 1, wherein said stopping mark is formed to be longer than the confirmation mark in a peripheral direction of the can barrel.

4. A method for manufacturing an embossed can body according to claim 1, wherein said stopping mark and said confirmation mark are formed on a same circular line on a surface of the can barrel.

5. A method for manufacturing an embossed can body according to claim 1, wherein said stopping mark and said confirmation mark are formed at positions different in height on a surface of the can barrel.

6. A method for manufacturing an embossed can body with a pattern printed on an outer surface of a cylindrical can barrel, comprising:

a plastic working step for forming a flange portion and a neck portion at an opening peripheral edge of the can barrel by work hardening so that a shape of the opening peripheral edge is maintained in a circular shape, and an embossing step for forming an embossed portion on at least a part of the pattern while aligning with the pattern, said embossing step including a step of inserting inside the can barrel an inner roller with an outer diameter less than an inner diameter of the neck portion of the can barrel, a step of disposing an outer roller outside the can barrel, a step of pressing the outer roller onto the can barrel, and a step of rotating the inner and outer rollers to emboss the can barrel.

7. A method for manufacturing an embossed can body according to claim 6, wherein said embossed can body is a three piece can including an upper lid, a bottom lid and the can barrel, and in the plastic working step, one of the upper and bottom lids is seamed to one end of the can barrel.

* * * * *